United States Patent [19]

Dinger et al.

[11] Patent Number: 4,683,823

[45] Date of Patent: Aug. 4, 1987

[54] SAFETY DEVICE FOR A PROJECTILE FUSE

[75] Inventors: Horst Dinger, Tennenbronn; Horst Moosmann, Schramberg, both of Fed. Rep. of Germany

[73] Assignee: Gebruder Junghans GmbH, Schramberg, Fed. Rep. of Germany

[21] Appl. No.: 865,438

[22] Filed: May 21, 1986

[30] Foreign Application Priority Data

May 31, 1985 [DE] Fed. Rep. of Germany ..... 3519517

[51] Int. Cl.[4] ..... F42C 15/00; F42C 15/26

[52] U.S. Cl. ..... 102/229; 102/249; 102/256

[58] Field of Search ..... 102/223, 229, 226, 249, 102/256, 233

[56] References Cited

U.S. PATENT DOCUMENTS

| | | | |
|---|---|---|---|
| 2,420,612 | 5/1947 | Nichols | 102/223 |
| 2,969,737 | 1/1961 | Bild | 102/229 |
| 3,143,071 | 8/1964 | Arnold et al. | 102/229 |
| 3,362,333 | 1/1968 | Czajkowski et al. | 102/229 |
| 4,015,533 | 4/1977 | Hermanson | 102/229 |
| 4,092,927 | 6/1978 | Rayle | 102/229 |

FOREIGN PATENT DOCUMENTS

| | | |
|---|---|---|
| 1703687 | 12/1971 | Fed. Rep. of Germany . |
| 2640782 | 1/1979 | Fed. Rep. of Germany . |

*Primary Examiner*—David H. Brown

*Attorney, Agent, or Firm*—Burns, Doane, Swecker & Mathis

[57] ABSTRACT

A projectile fuse comprises a rotor rotatable from a safety position to a live position. A slide is arranged to immobilize the rotor in its safety position. A piston is operably connected to the slide for displacing the slide to release the rotor for rotation. A conduit communicates one end of the piston with air pressure generated in response to firing of the projectile to shift the slide in a manner displacing the slide to release the rotor.

4 Claims, 4 Drawing Figures

SAFETY DEVICE FOR A PROJECTILE FUSE

BACKGROUND AND OBJECTS OF THE INVENTION

The invention concerns a safety device for a rotor of a projectile fuse, in particular, a missile fuse.

German Publication No. DE-26 40 782 describes a safety device on a projectile fuse. A rotor is held in the safety position by an axially displaceable inertial bolt. The latter releases the rotor upon the firing of the projectile. A torsion spring then rotates the rotor into the live position.

It is the object of the invention to provide a safety device of the afore-mentioned type, whereby the rotor is released by the effect of dynamic pressure.

SUMMARY OF THE INVENTION

This object is attained according to the invention wherein an air pressure space containing a piston is provided. The piston acts upon a slide, immobilizing the rotor in the rest position of the piston and releasing it in the displaced position of the piston. Upon firing, the piston is displaced by the effect of the dynamic pressure. The slide is thereby released from the rotor and the latter rotates into its live position.

BRIEF DESCRIPTION OF THE DRAWING

Further advantageous embodiments of the invention will become apparent from the following description of a preferred embodiment wherein.

DETAILED DESCRIPTION OF A PREFERRED EMBODIMENT OF THE INVENTION

Figure 1:
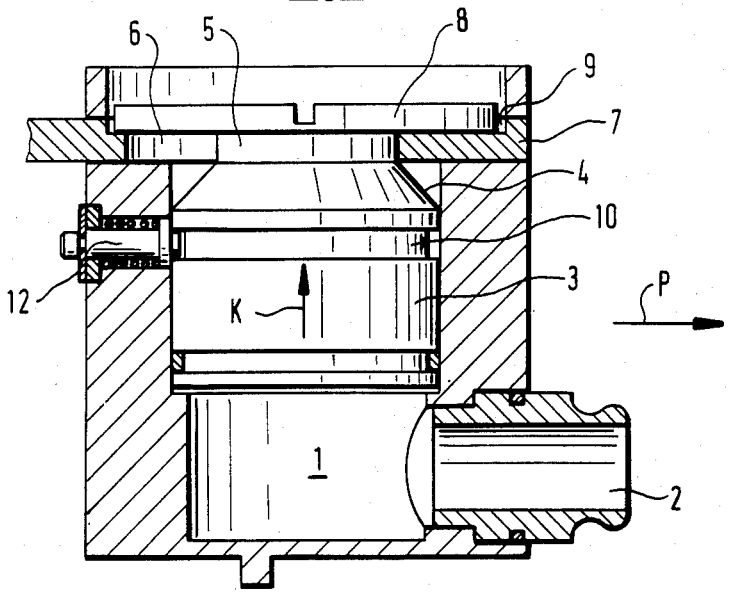
FIG. 1 is a sectional view through a portion of a safety device taken along line 1—1 in FIG. 2.

An air pressure space 1 is provided in a fuse. The space 1 is connected by means of a line 2 with an orifice in the head of a projectile such as a missle, not shown in detail. The dynamic pressure acting on the head upon firing of the missile then pressurizes the air pressure space 1. The firing direction of the missle is indicated by the arrow P.

A piston 3 is located in the air pressure space 1 and is displaceable transversely relative to the firing direction P. The piston 3 has, at its end facing away from the air pressure space 1, a guide cone 4 terminating in a cylindrical segment 5. The cylindrical segment 5 engages a circular orifice 6 of a member in the form of a slide 7. The slide 7 is held on the piston 3 by means of a head 8 threaded to the piston. In the position shown in FIG. 1, the head 8 is located in a recess 9 of the slide 7 and is thereby secured against displacement from impacts occurring during environmental testing.

The piston 3 has an annular external groove 10 which is engaged by bolt 12 loaded by a spring 11. The bolt 12 secures the piston 3 against displacement when, in the course of environmental testing, impacts are applied in the direction of the displacement of the piston 3.

The slide 7 has an extension 13 which engages a recess 14 of a rotor 15. The latter is thereby held in a safety position against rotation around its axle A.

Figure 2:
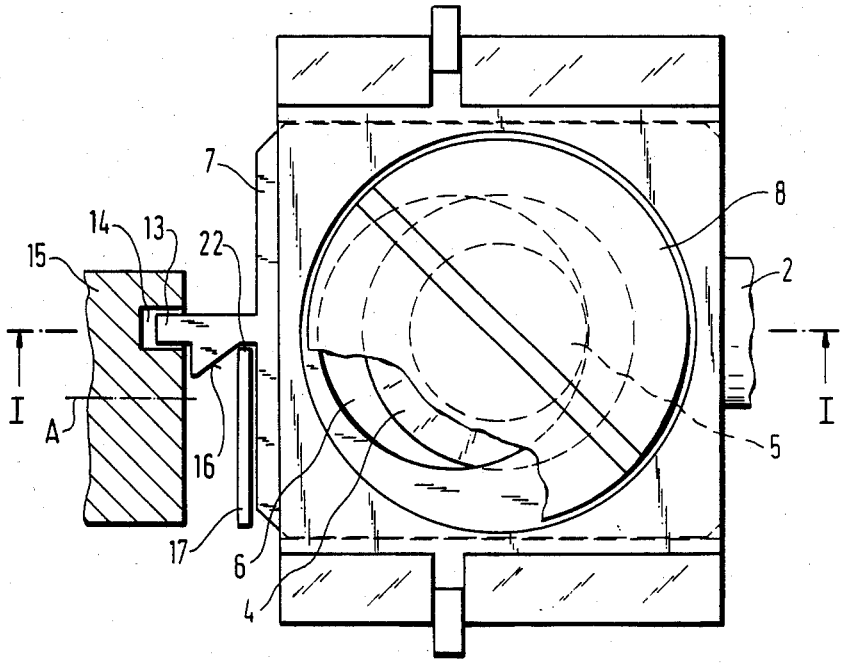
FIG. 2 is a top plan view of the part shown in FIG. 1.
Figure 3:
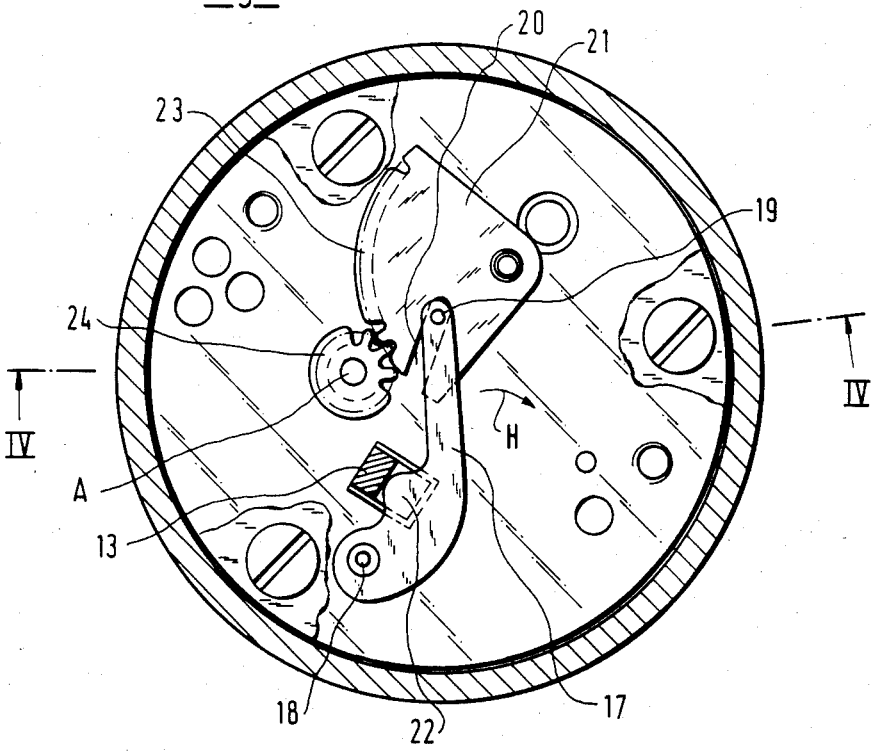
FIG. 3 is a top plan view of a safety device.

On the extension 13 a beveled surface 16 is formed (FIG. 2). An arm in the form of a 192 lever 17 is associated with the surface 16. The lever 17 is supported rotatably at one end 18 (FIG. 3). The other lever end comprises a lug 19 received in a slot 20 of a pivotally mounted segment-shaped toothed element 21. Between the end 18 and the lug 19 the lever 17 includes a nose 22 which abuts against the extension 13.

Figure 4:
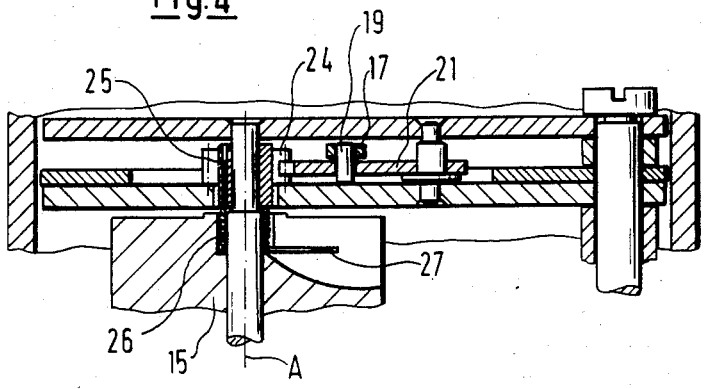
FIG. 4 is a sectional view taken along line IV—IV of FIG. 3.

A toothed driven member in the form of a wheel 24, rotatable around the rotor axle A, engages teeth 23 of the element 21. An end 25 of a torsion spring 26 is fastened to the drive member 24, while the other end 27 of the spring 26 acts against the rotor 15 (FIG. 4).

If the missile is fired while the fuse is in the safety position (shown in the figures), the bolt 12 is released from the groove 10 by the inertia effect during the firing acceleration. The dynamic air pressure acting on the tip of the missile displaces the piston 3 in the direction of the arrow K (FIG. 1). In the process, the head 8 emerges from the recess 9 and the guide cone 4 cams the slide 7 to an unlocking position, so that its extension 13 moves out of the recess 14. The rotor 15 is thereby released but has not yet rotated into its live position.

Simultaneously, the beveled surface 16 pivots lever 17 in the direction of the arrow H. The cams the lever 17 wheels elément 21 is thereby pivotingly displaced and its teeth 23 cause the driven member 24 to rotate. The rotation of the driven member 24 stresses the torsion spring 26, which thereupon rotates the rotor by about 260° into its live position.

By placing the piston 3 so that its movement K is at an angle of 90° relative to the firing direction P, essentially only dynamic air pressure acts on the piston 3; the firing acceleration has practically no effect on its motion. In addition, the piston 3 may be secured and released in a simple manner by the bolt 12. Moreover, the piston 3, when secured, also holds the slide 7 by positive action.

Impacts applied to the fuse in the course of environmental testing may cause a movement of the lever 17 and thus of the element 21. This does not present a problem since such a motion cannot be transmitted to the rotor 15, because the latter is held in its safety position by the extension 13 of the slide 7. During assembly of the fuse, the drive member 24 is mounted together with the tension spring 26, prestressed in the opposite direction, so that the rotor 15 is biased toward the safety position.

Although the present invention has been described in connection with a preferred embodiment thereof, it will be appreciated by those skilled in the art that modifications, substitutions, additions, and deletions not specifically described may be made without departing from the spirit and scope of the invention as defined in the appended claims.

What we claim is:

1. A fuse for a projectile, such as a rocket, comprising:

a rotor rotatable from a safety position to a live position, a rotor spring operably connected to said rotor for rotating said rotor to said live position when said rotor spring is tensioned, a rotatable wheel operably connected to said rotor spring for tensioning said rotor spring, a rotatable toothed element operably connected to said wheel for rotating said wheel to tension said rotor spring, a movable arm operably connected to said toothed element for rotating the latter, and means for rotating said arm comprising:

a ram pressure piston movable in a direction transverse relative to a direction of firing of the projectile, means communicating said piston with ram prssure for urging said piston in said transverse direction when the projectile is fired, a spring-loaded bolt biased in said direction of firing into locking relationship with said piston, such that said bolt releases said piston for transverse movement in response to firing of the projectile, and a movable member including a locking portion releasably engaging said rotor to prevent said rotor from rotating, said member being operably connected to said piston to be displaced by said piston, in response to transverse movement of the latter, in a manner moving said member to an unlocking position in which said locking portion releases said rotor, said member being operably connected to said arm for moving the latter to rotate said toothed element in response to movement of said member to its unlocking position whereby said toothed element rotates said wheel to tension said rotor spring, and said tensioned rotor spring rotates said rotor to its live position.

2. A fuse according to claim 1, wherein said member comprises a slide, said arm comprising a pivoted lever, said slide including a beveled portion which cams said lever into pivotal movement when said slide is moved to its unlocking position.

3. A fuse according to claim 1, wherein said member comprises a slide, said slide including a recess, a portion of said piston extending into said recess to move said slide to its unlocking position.

4. A fuse according to claim 3, wherein said portion of said piston comprises a conical portion which cams said slide into movement.

* * * * *